US008152283B2

(12) United States Patent
Owaki

(10) Patent No.: US 8,152,283 B2
(45) Date of Patent: Apr. 10, 2012

(54) LIQUID-JET HEAD AND LIQUID-JET APPARATUS

(75) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 1006 days.

(21) Appl. No.: 11/797,573

(22) Filed: May 4, 2007

(65) Prior Publication Data

US 2007/0263041 A1 Nov. 15, 2007

(30) Foreign Application Priority Data

May 8, 2006 (JP) ..... 2006-129557

(51) Int. Cl.
*B41J 2/045* (2006.01)

(52) U.S. Cl. ..... 347/71; 29/890.1

(58) Field of Classification Search ..... 347/68, 347/71; 29/890.1

See application file for complete search history.

(56) References Cited

U.S. PATENT DOCUMENTS

| | | | | | |
|---|---|---|---|---|---|
| 4,459,601 | A * | 7/1984 | Howkins | 347/68 |
| 4,463,362 | A * | 7/1984 | Thomas | 347/86 |
| 4,695,854 | A * | 9/1987 | Cruz-Uribe | 347/40 |
| 4,730,197 | A * | 3/1988 | Raman et al. | 347/40 |
| 4,915,718 | A * | 4/1990 | Desai | 65/31 |
| 5,581,288 | A * | 12/1996 | Shimizu et al. | 347/87 |
| 5,874,971 | A * | 2/1999 | Nishioka et al. | 347/20 |
| 5,943,079 | A * | 8/1999 | Yoshida | 347/94 |
| 5,997,125 | A * | 12/1999 | Nishioka et al. | 347/20 |
| 6,010,209 | A * | 1/2000 | Kitahara | 347/71 |
| 6,074,036 | A * | 6/2000 | Nishioka et al. | 347/20 |
| 6,322,203 | B1 * | 11/2001 | Kitahara | 347/70 |
| 6,394,589 | B1 * | 5/2002 | Willus et al. | 347/68 |
| 6,502,930 | B1 * | 1/2003 | Shimada et al. | 347/71 |
| 6,616,270 | B1 * | 9/2003 | Miyata et al. | 347/68 |
| 6,758,554 | B2 * | 7/2004 | Kamei et al. | 347/70 |
| 6,796,640 | B2 * | 9/2004 | Miyata | 347/71 |
| 6,813,831 | B2 * | 11/2004 | Kamei et al. | 29/890.1 |
| 7,011,396 | B2 * | 3/2006 | Moynihan et al. | 347/68 |
| 7,018,023 | B2 * | 3/2006 | Shimada | 347/71 |
| 7,152,963 | B2 * | 12/2006 | Owaki et al. | 347/68 |
| 7,182,432 | B2 * | 2/2007 | Van Den Berg et al. | 347/46 |
| 7,497,962 | B2 * | 3/2009 | Tokunaga | 216/27 |
| 2003/0107619 | A1 * | 6/2003 | Kitahara | 347/65 |
| 2003/0117464 | A1 * | 6/2003 | Miyata | 347/71 |
| 2003/0122900 | A1 * | 7/2003 | Nakamura et al. | 347/68 |
| 2003/0206218 | A1 * | 11/2003 | Miyata et al. | 347/70 |
| 2004/0130601 | A1 * | 7/2004 | Shimada | 347/68 |
| 2004/0201644 | A1 * | 10/2004 | Van Den Berg et al. | 347/46 |
| 2005/0046678 | A1 * | 3/2005 | Owaki et al. | 347/68 |

FOREIGN PATENT DOCUMENTS

| | | |
|---|---|---|
| JP | 2001-105611 A | 4/2001 |
| JP | 2004-106316 A | 4/2004 |
| JP | 2004-114404 A | 4/2004 |
| JP | 2005-219243 A | 8/2005 |

* cited by examiner

*Primary Examiner* — Charlie Peng
*Assistant Examiner* — Peter Radkowski
(74) *Attorney, Agent, or Firm* — Sughrue Mion, PLLC

(57) ABSTRACT

A liquid-jet head has a passage-forming substrate with an individual path including a pressure-generating chamber communicating with a nozzle orifice which ejects a liquid. The head also has a pressure-generating element, a protection plate, a reservoir, a compliance plate, a through hole, an introducing path, and a flexible portion with flexibility in a region of the compliance plate, the region facing the reservoir, which region covers at least from a part facing the through hole to a part surrounding the introducing path.

11 Claims, 10 Drawing Sheets

LIQUID-JET HEAD AND LIQUID-JET APPARATUS

The entire disclosure of Japanese Patent Application No. 2006-129557 filed May 8, 2006 is expressly incorporated by reference herein.

BACKGROUND

1. Technical Field

The present invention relates to a liquid-jet head, and a liquid-jet apparatus. Specifically, the invention relates to an ink-jet recording head for ejecting ink as a liquid, and an ink-jet recording apparatus.

2. Related Art

As an ink-jet recording head, which is a liquid-jet head, there is an ink-jet recording head including a passage-forming substrate, piezoelectric elements and a reservoir forming plate. The passage-forming substrate includes pressure-generating chambers and a communicating portion. The pressure-generating chambers communicate respectively with nozzle orifices. The communicating portion is provided, on the side of one end of each pressure-generating chamber in the longitudinal direction, and along a direction of the shorter side (hereinafter, such a direction is referred to as the shorter-side direction) of each pressure-generating chamber. The communicating portion communicates with the pressure-generating chambers. The piezoelectric elements are formed on one surface side of the passage-forming substrate. The reservoir forming plate is joined to the surface of the passage-forming substrate on the piezoelectric elements side with an adhesive agent, and includes a reservoir portion constituting a part of a reservoir together with the communicating portion (for example, refer to JP-A-2005-219243 (pp. 6 to 8, FIGS. 3 to 5)).

In such a configuration described in JP-A-2005-219243, there is a problem that the size of the ink-jet recording head becomes large in the longitudinal direction of the pressure-generating chambers since the communicating portion constituting a part of the reservoir is provided on the ends of these pressure-generating chambers in the longitudinal direction.

Moreover, there is an ink-jet recording head including a reservoir provided on a region facing a piezoelectric element holding portion of a reservoir forming plate which is joined to a passage-forming substrate (JP-A-2001-105611 (pp. 8 to 9, FIGS. 6 to 8)), and JP-A-2004-106316 (p. 6, FIG. 11)).

According to the above configuration, the size of the ink-jet recording head can be reduced in the longitudinal direction of the pressure-generating chambers. However, there is a problem that ink ejection characteristics are deteriorated by compliance to a pressure-generating chamber from an adjacent pressure-generating chamber when ink is ejected therefrom.

In addition, there is a problem that a negative influence on ink ejection occurs due to the occurrence of compliance during the introduction of ink from a storage in which the ink is stored.

Moreover, when a drive circuit for driving piezoelectric elements is to be mounted on the reservoir forming plate, there is a problem that a compliance plate causing compliance to occur cannot be arranged.

SUMMARY

An advantage of some aspects of the invention is to provide a liquid-jet head whose liquid ejection characteristics are improved by reducing compliance, and whose size is reduced as well, and a liquid-jet apparatus using the liquid-jet head.

A first aspect of the invention for solving the aforementioned problems provides a liquid-jet head with the following characteristics. The liquid-jet head includes a passage-forming substrate, a pressure-generating chamber, a protection plate, a reservoir, a compliance plate, a through hole, an introducing path and a flexible portion with flexibility. The passage-forming substrate is provided with an individual path including a pressure-generating chamber communicating with a nozzle orifice which ejects a liquid. The pressure-generating element is provided in a region facing the pressure-generating chamber on the side of a first surface of the passage-forming substrate. The protection plate is joined to the first surface of the passage-forming substrate on the pressure-generating chamber side, and is provided with a pressure-generating element holding portion having the pressure-generating element arranged therein on a first surface of the protection plate. The reservoir is formed in a region on the side of a second surface of the protection plate, the region facing the pressure-generating element holding portion. The compliance plate is formed on a surface of the reservoir on the opposite side to the passage-forming substrate. The through hole is provided in a region in the protection plate on a first end side in the longitudinal direction of the pressure-generating chamber. The through hole causes the reservoir to communicate with the individual path. The introducing path is provided in a region in the compliance plate on a second end side in the longitudinal direction of the pressure-generating chamber. The introducing path supplies the liquid to the reservoir from a storage having the liquid stored therein. The flexible portion is provided in a region, facing the reservoir, of the compliance plate, which region covers at least from a part facing the through hole to a part surrounding the introducing path.

According to the first aspect, the reservoir is provided in the region, facing the pressure-generating element holding portion (the piezoelectric element holding portion), in the protection plate. Accordingly, the width, in the longitudinal direction of the pressure-generating chamber, of the liquid-jet head can be reduced. This makes it possible to reduce the size of the liquid-jet head. In addition, the reservoir is sealed by the compliance plate, while the flexible portion is provided in a region, facing the reservoir, of the compliance plate, which region covers at least from a part facing the through hole to a part surrounding the introducing path. Accordingly, the compliance, which is generated due to a stress fluctuation in the pressure-generating chamber at the time when a liquid is ejected, can be reduced by the flexible portion in the part facing the through hole. Moreover, the compliance, which is generated when a liquid is supplied from the storage having a liquid stored therein to the reservoir, can be reduced by the flexible portion in the part surrounding the introducing path. As a result, liquid ejection properties can be improved.

A second aspect of the invention provides the liquid-jet head according to the first aspect, in which the flexible portion in the compliance plate is provided continuously over the pressure-generating chamber in the longitudinal direction.

In this case, the flexible portion can be provided in a wider area than otherwise. Accordingly, the compliance in the reservoir can be further securely reduced.

A third aspect of the invention provides the liquid-jet head according to the first or second aspect with the following characteristics. Specifically, a head case provided with an introducing port which communicates with the introducing path is joined to the compliance plate, while a drive circuit, which drives the pressure-generating element, is mounted on the head case.

In this case, the drive circuit is mounted on the head case. Thus, the compliance plate can be provided on the protection plate.

A fourth aspect of the invention provides the liquid-jet head according to the first or second aspect with the following characteristics. Specifically, a drive circuit is mounted on the top of the passage-forming substrate, and is also arranged in parallel to, and being separated from, the protection plate.

In this case, the compliance plate can be provided to the top of the protection plate while a driving wiring such as a bonding wire for connecting the drive circuit to the piezoelectric element is no longer required. Accordingly, the piezoelectric element can be arranged in high density. In addition, by separating the drive circuit from the protection plate, an adhesive agent having an ink resistant property is no longer necessary when the protection plate is mounted to the top of the passage-forming substrate. As a result, the manufacturing processes can be simplified, and thus manufacturing costs can be reduced.

A fifth aspect of the invention provides the liquid-jet head according to any one of the first to fourth aspects, in which the through hole is provided independently for each individual path group formed of a plurality of individual paths.

In this case, the matching of the positions of the protection plate and the passage-forming substrate can be made easier than otherwise. Accordingly, it is possible to prevent a liquid supply failure or the like from occurring.

A sixth aspect of the invention provides the liquid-jet head according to any one of the first to fourth aspects, in which the through hole is independently provided for each individual path.

In this case, it is possible to prevent pressure-generating chambers from being influenced by the compliance generated by an adjacent pressure-generating chamber when the ink is ejected from the adjacent pressure-generating chamber.

A seventh aspect of the invention provides the liquid-jet head according to anyone of the first to sixth aspects with the following characteristics. Specifically, in the liquid-jet head, the individual path includes at least the pressure-generating chamber and a liquid supply path which communicates with one end of the pressure-generating chamber, which has a cross-sectional area smaller than that of the pressure-generating chamber, in the width direction, and which generates a passage resistance to a liquid supplied from the reservoir.

In this case, it is possible to cause a passage resistance to be generated in a liquid with the liquid supply path. As a result, the liquid ejection property can be improved.

An eighth aspect of the invention provides the liquid-jet head according to the sixth aspect includes the following characteristics. Specifically, in the liquid-jet head, the individual path is formed of the pressure-generating chamber, while the through hole functions as a liquid supply path which generates a passage resistance to a liquid supplied from the reservoir.

In this case, only the pressure-generating chamber is formed in the passage-forming substrate. As a result, it is possible to reduce the size of the liquid-jet head in the width direction, which is the longitudinal direction of the pressure-generating chamber.

A ninth aspect of the invention provides the liquid-jet head according to anyone of the first to eighth aspects with the following feature. Specifically, in the liquid-jet head, a reservoir forming plate which defines a side surface of the reservoir is joined onto the protection plate.

In this case, the processing of the protection plate 30 can be made easier. As a result, the manufacturing costs can be reduced.

A tenth aspect of the invention provides a liquid-jet apparatus including a liquid-jet head according to any one of the first to ninth aspects.

In this case, it is possible to achieve a liquid-jet apparatus whose size is reduced, and whose liquid jet properties are improved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be explained in detail on the basis of embodiments.

Embodiment 1

Figure 1:
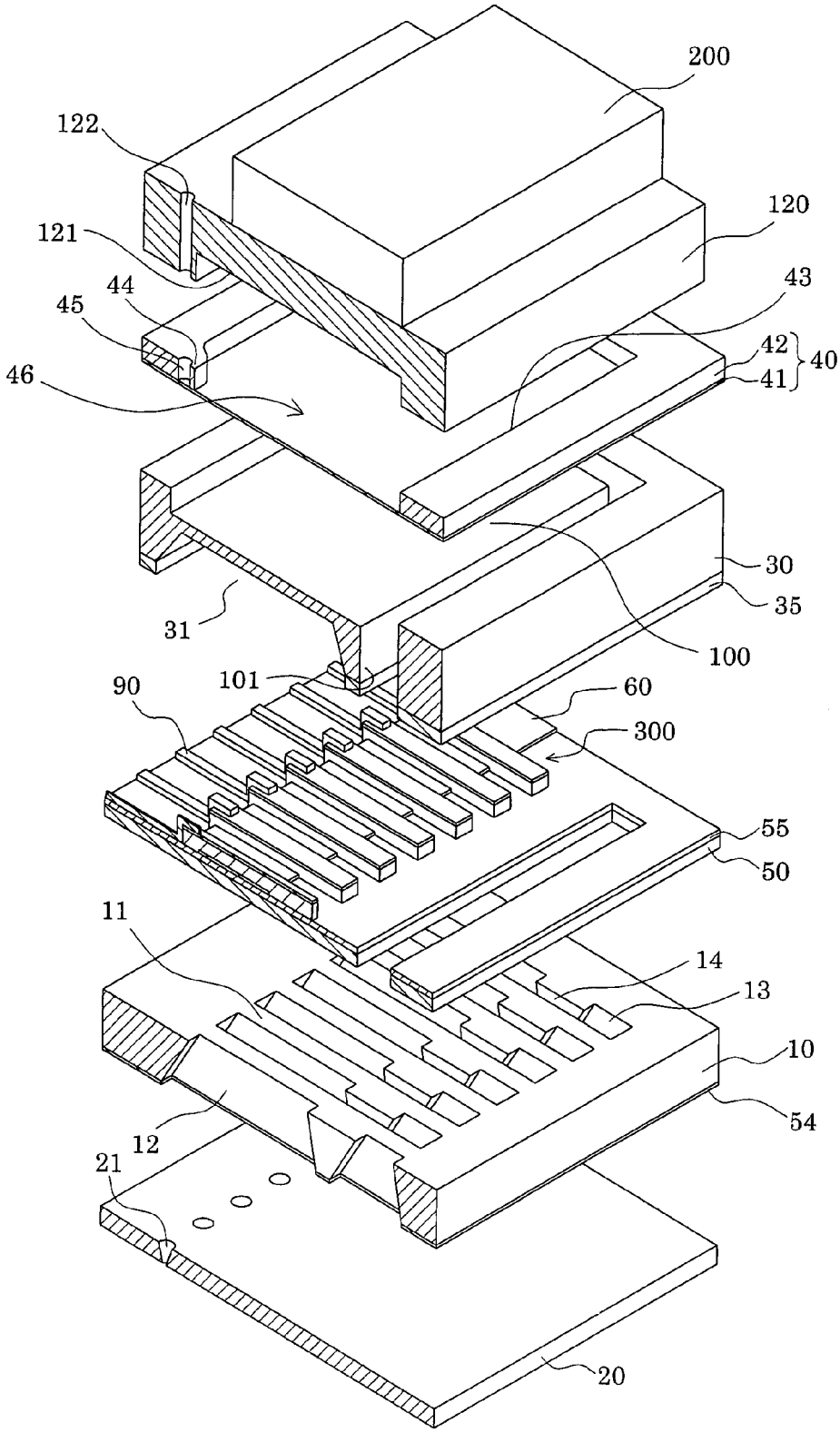
FIG. 1 is an exploded perspective view of a recording head according to Embodiment 1.
Figure 2A:
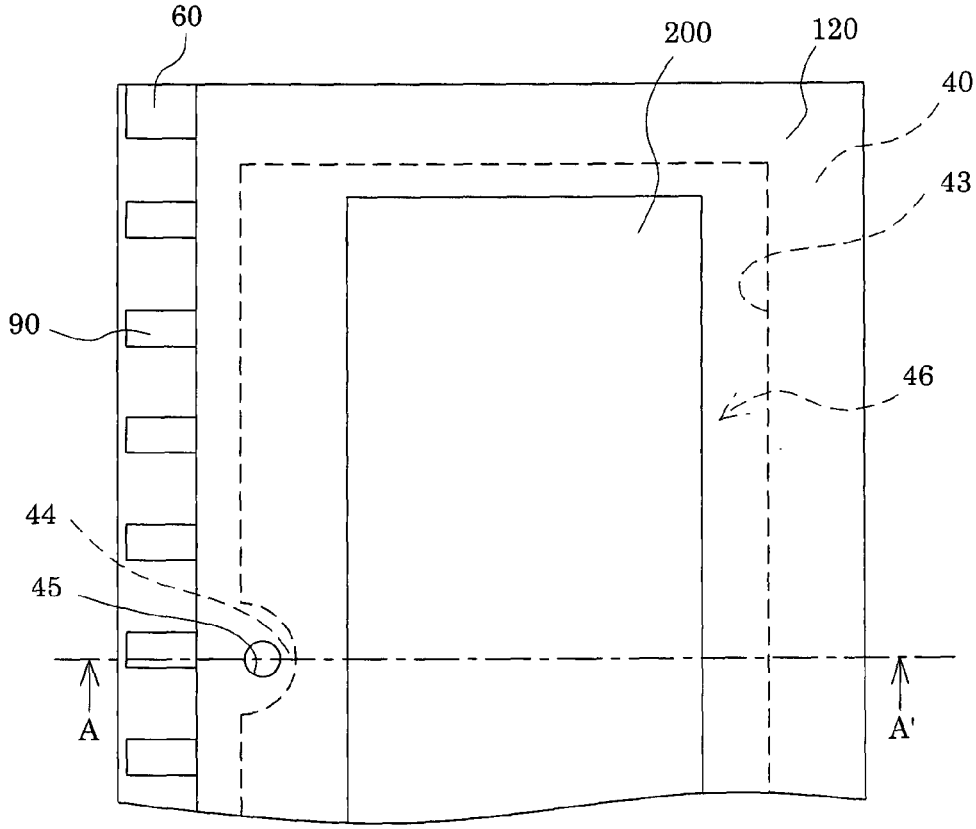
FIGS. 2A and 2B are flat and cross-sectional views of the recording head according to Embodiment 1, respectively.
Figure 2B:
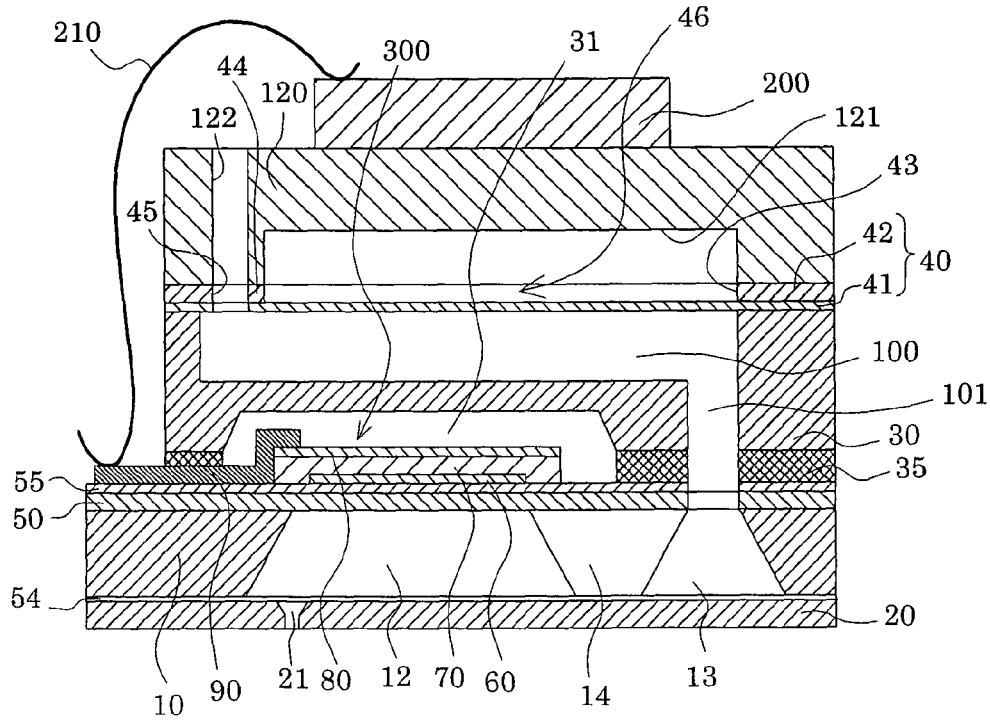

FIG. 1 is an exploded perspective view showing an ink-jet recording head that is an example of a liquid-jet head according to Embodiment 1 of the invention. FIG. 2A is a plan view of FIG. 1. FIG. 2B is a cross-sectional view taken along the line A-A' of FIG. 2A. As illustrated, a passage-forming substrate 10 is formed of a single-crystal silicon substrate with (110) crystal plane orientation in this embodiment. In addition, an elastic film 50, made of silicon dioxide, and having a thickness of 0.5 μm to 2 μm, is previously formed on one surface of the passage-forming substrate 10 by thermal oxidization in this embodiment.

In the passage-forming substrate 10, pressure-generating chambers 12 are provided by anisotropically etching the passage-forming substrate 10 from the other surface thereof. The pressure-generating chambers 12 are partitioned by a plurality of compartment walls 11, and are arranged in the width direction thereof (the shorter-side direction). Moreover, the passage-forming substrate 10 includes ink supply paths 14, and communicating portions 13 which are partitioned by the compartment walls 11. The ink supply paths 14 and the communicating portions 13 are an example of liquid supply paths each constituting an individual path for each nozzle orifice which is to be described later in details with the corresponding pressure-generating chamber 12.

Each of the ink supply paths 14 communicates with one end of the corresponding pressure-generating chamber 12 in the longitudinal direction, and has a cross-sectional area smaller than that of each pressure-generating chamber 12. For example, in this embodiment, each of the ink supply paths 14 is formed in a width smaller than that of each of the pressure-generating chambers 12 by narrowing, in the width direction, the corresponding passage on the pressure-generating chamber 12 side between a reservoir 100 and each of the pressure-generating chambers 12. It should be noted that although each of the ink supply paths 14 is formed by narrowing the width of the passage from one side as described above, an ink supply path may be formed by narrowing the width of the passage from both sides. In addition, instead of narrowing the width of the passage, the ink supply path may be formed by narrowing the passage in the thickness direction. Moreover, each of the communicating portions 13 communicates with a region opposite to each of the pressure-generating chambers 12 of the ink supply paths 14, and has a cross-sectional area larger than that of each of the ink supply paths 14 in the width direction (the shorter-side direction). In this embodiment, the communicating portions 13 having the same cross-sectional areas as those of the pressure-generating chambers 12, respectively, are formed.

Specifically, the passage-forming substrate 10 is provided with individual paths each constituted of the pressure-generating chamber 12, the ink supply path 14 and the communicating portion 13. The ink supply path 14 has a cross-sectional area smaller than that of each of the pressure-generating chambers 12 in the shorter-side direction. The communicating portion 13 communicates with the corresponding ink supply path 14, and has a cross-sectional area larger than that of the ink supply path 14 in the shorter-side direction. The individual paths are partitioned by the plurality of compartment walls 11.

As an example of a nozzle forming member provided with nozzle orifices 21 each communicating with a vicinity of an end portion opposite to the ink supply path 14 of the pressure-generating chamber 12, a nozzle plate 20 is fixed to a surface of the passage-forming substrate 10, where the individual paths such as the pressure-generating chambers 12 open, with an adhesive agent or a thermal adhesive film. It should be noted that the nozzle plate 20 is made of, for example, glass-ceramic materials, a single-crystal silicon substrate, a stainless steel or the like.

On the other hand, the elastic film 50 having a thickness of, for example, about 1.0 μm is formed on the opposite surface of the passage-forming substrate 10 from the nozzle plate 20, as described above. On the elastic film 50, an insulation film 55 having a thickness of, for example, about 0.4 μm is formed. Moreover, on the insulation film 55, a lower electrode film 60 having a thickness of, for example, about 0.2 μm, piezoelectric layers 70 each having a thickness of, for example, about 1.0 μm, and upper electrode films 80 each having a thickness of, for example, about 0.05 μm are laminated by means of a process to be described later. The lower electrode film 60, each of the piezoelectric layers 70 and a corresponding one of the upper electrode films 80 constitute one piezoelectric element 300. Here, each of the piezoelectric elements 300 indicates a portion including the lower electrode film 60, one of the piezoelectric layers 70 and a corresponding one of the upper electrode films 80. In general, each of the piezoelectric elements 300 is configured in the following manner. One of the electrodes of each piezoelectric element 300 is used as a common electrode. Then, the other one of the electrodes and the corresponding one of the piezoelectric layers 70 are patterned for each of the pressure-generating chambers 12. In this embodiment, the lower electrode film 60 is used as a common electrode for the piezoelectric elements 300, and each upper electrode film 80 is used as an individual electrode. However, it does not matter even if functions of the two electrode films are reversed due to the conditions of a drive circuit or wirings.

Moreover, lead electrodes 90 of gold (Au) or the like are connected respectively to the upper electrode films 80 of the piezoelectric elements 300 as described above. Each of the lead electrodes 90 is extended to a vicinity of an end portion opposite to a corresponding one of the ink supply paths 14 of the passage-forming substrate 10. A voltage is selectively applied to each of the piezoelectric elements 300 via a corresponding one of the lead electrodes 90.

In addition, a protection plate 30 is joined, with an adhesive agent 35 or the like, to the top of the passage-forming substrate 10 on which the piezoelectric elements 300 are formed. The protection plate 30 includes, in a region facing the piezoelectric elements 300, a piezoelectric element holding portion 31 (a pressure-generating element holding portion) having enough space to allow an uninhibited movement of the piezoelectric elements 300. The piezoelectric elements 300 are disposed inside this piezoelectric element holding portion 31. The piezoelectric elements 300 are protected so that the piezoelectric elements 300 are hardly influenced by the outside environment. It does not matter whether or not the piezoelectric elements 300 are sealed. In addition, the piezoelectric element holding portion 31 may be provided individually for each of the piezoelectric elements 300, or may be provided to continuously cover the plurality of piezoelectric elements 300. In this embodiment, the piezoelectric element holding portion 31 is provided to continuously cover the plurality of piezoelectric elements 300.

Furthermore, the reservoir 100, which serves as a common ink chamber (liquid chamber) for the plurality of individual paths, is provided on a region opposite to the piezoelectric element holding portion 31 on the protection plate 30. In this embodiment, the reservoir 100 is formed into a recessed portion provided on the side opposite the joint surface of the protection plate 30 from the passage-forming substrate 10. That is, the reservoir 100 opens to a region opposite to the passage-forming substrate 10 of the protection plate 30. The opening of the reservoir 100 is sealed by a compliance plate 40 which is to be described in detail later. The reservoir 100 is provided continuously along the plurality of individual paths in the shorter-side direction (the width direction). The reservoir 100 is provided also to extend to vicinities of both ends of the protection plate 30 in the longitudinal direction of the pressure-generating chamber 12. One end of the reservoir 100 is provided to a region facing the ends of the individual paths.

Moreover, on the protection plate 30, a through hole 101, which penetrates through in the thickness direction is provided. One end of the through hole 101 communicates with one end of each communicating portion 13 which is the individual path, and the other end of the through hole 13 communicates with one end of the reservoir 100. In this embodiment, the through hole 101 is solely provided continuously across the communicating portions 13 which are the plurality of individual paths. Ink from the reservoir 100 is supplied via the through hole 101 to the communicating portions 13, the ink supply paths 14 and the pressure-generating chambers 12, which are the individual paths.

As a material of such a protection plate 30, it is possible to use, for example, glass, a ceramic material, metal, resin or the like. However, the protection plate 30 is preferably formed of a material having substantially the same thermal expansion coefficient as that of the passage-forming substrate 10. In this embodiment, a single-crystal silicon substrate, which is the same as that of the passage-forming substrate 10, is used as the material of the protection plate 30.

In addition, the compliance plate 40 including a sealing film 41 and a fixing plate 42 is joined to the surface of the protection plate 30, where the reservoir 100 opens. The opening of the reservoir 100 is sealed by the compliance plate 40.

The sealing film 41 is made of a material having flexibility and low rigidity, e.g. a polyphenylene sulfide (PPS) film or the like having a thickness of approximately several μm.

Additionally, the fixing plate 42 is made of a hard material such as a metal including a stainless steel (SUS) or the like having a thickness of several tens of μm. As shown in FIGS. 2A and 2B, the fixing plate 42 is provided over the periphery of the reservoir 100 of the protection plate 30. The region opposite to the reservoir 100 in fixing plate 42 is completely removed in the thickness direction so as to be an opening portion 43. Moreover, the fixing plate 42 is provided with a protrusion 44 protruding into the opening portion 43. This protrusion 44 is provided with an introducing path 45 which penetrates the protrusion 44 in the thickness direction, and which supplies ink to the reservoir from a storage (not shown) having ink stored therein. In this embodiment, the protrusion 44 is provided at the side opposite to the through hole 101 in a manner that part of the protrusion 44 in the direction, in which the pressure-generating chambers 12 are arranged in parallel, protrudes into a region facing the reservoir 100 in a canopy like manner. Thus, the introducing path 45 is provided at the end of the pressure-generating chamber 12 in the longitudinal direction, which end is opposite to the through hole 101 provided in the protection plate 30. As described above, by providing the introducing path 45 at the end opposite to the through hole 101 of the protection plate 30, it is possible to curb the influence due to the dynamic pressure of the ink introduced from the storage exerted on the pressure-generating chambers 12 via the through hole 101.

In addition, because of the opening portion 43 of the aforementioned fixing plate 42, one side face of the reservoir 100 is sealed by only a sealing film 41 having flexibility so as to be a flexible portion 46 which is flexurally deformed. Specifically, in this embodiment, the flexible portion 46 is provided on a part facing the through hole 101 of the protection plate 30 and a part surrounding the introducing path 45 of the fixing plate 42, in a part facing the reservoir 100. In other words, the flexible portion 46 is provided continuously across the part facing the through hole 101 and the part surrounding the introduction path 45. As described above, by providing the flexible portion 46 continuously across the part facing the through hole 101 and the part surrounding the introduction path 45, the flexible portion 46 can be formed to have a wide area. Accordingly, the compliance in the reservoir 100 is increased, and the occurrence of cross talk due to the negative influence of a pressure fluctuation can be thus securely reduced.

Moreover, a head case 120 is joined to the top of the compliance plate 40. The head case 120 includes a recessed portion 121 in a region facing the opening portion 43 of the compliance plate 40. The flexible portion 46 flexurally deforms with this recessed portion 121 as appropriate.

In addition, the head case 120 is provided with an ink introducing port 122, which is an example of a liquid introducing port communicating with the introducing path 45 of the compliance plate 40, and which is also penetrates the head case 120 in the thickness direction. This ink introducing port 122 communicates with the storage (not shown) having ink stored therein. The ink from the storage is introduced via the ink introducing port 122.

Moreover, a drive circuit 200 for driving the piezoelectric elements 300 is mounted on the head case 120. A circuit board, a semiconductor integrated circuit (IC), or the like can be employed as the drive circuit 200, for example. In addition, the tip of the lead electrode 90 withdrawn from each piezoelectric element 300 to the outside of the piezoelectric element holding portion 31 is electrically connected to the drive circuit 200 with a driving wiring 210 made of a bonding wire or the like.

In the ink-jet recording head of the embodiment as described above, ink is firstly taken in from an unillustrated external storage having ink stored therein via the ink introducing port 122 and the introducing passage 45, so that the inside of the ink-jet recording head, from the reservoir 100 to the nozzle orifices 21, is filled with the ink thus taken in. Then, voltage is applied between the lower electrode film 60 and the upper electrode films 80, which correspond to the respective pressure-generating chambers 12 in accordance with recording signals transmitted from the drive circuit 200. Accordingly, the piezoelectric elements 300 and vibration plates are flexurally deformed so that the pressure in each pressure-generating chamber 12 is increased. As a result, ink droplets are ejected from the nozzle orifices 21.

As has been described so far, in this embodiment, the reservoir 100 is provided in the region, on the protection plate 30, facing the piezoelectric element holding portion 31. Accordingly, the width, in the longitudinal direction of the pressure-generating chamber 12, of the ink-jet recording head can be reduced, and thereby, it is possible to reduce the size of the ink-jet recording head.

Moreover, the head case 120 is provided on the compliance plate 40, and the drive circuit 200 for driving the piezoelectric elements 300 is provided on this head case 120. Accordingly, the compliance plate 40 including the flexible portion 46 can be provided on the protection plate 30. In addition, the reservoir 100 is sealed with the compliance plate 40, and the flexible portion 46 is provided in the region, facing the reservoir 100, of the compliance plate 40, which region covers at least from the part facing the through hole 101 to the part surrounding the introducing path 45. Accordingly, the compliance due to a change in stress of the pressure-generating chambers 12 at the time when ink is ejected is increased by the flexible portion 46 of the part facing the through hole 101. As a result, negative influence due to the change in pressure can be reduced. Moreover, the negative influence due to the change in pressure at the time when ink is supplied from the storage having ink stored therein to the reservoir 100 can be reduced by the flexible portion 46 at the part surrounding the introducing path 45. As a result, ink ejection properties can be improved.

Hereinafter, a method of manufacturing such an ink-jet recording head will be explained with reference to FIGS. 3A to 10.

Figure 3A:
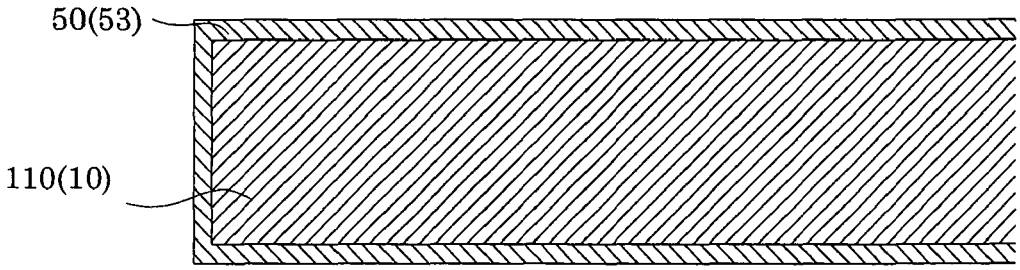
FIGS. 3A to 3D are cross-sectional views showing manufacturing processes of the recording head according to Embodiment 1.

Firstly, as shown in FIG. 3A, a wafer 110 for a passage-forming substrate, which is a silicon wafer, is thermally oxidized in a diffusion furnace at a temperature of approximately 1100° C. Then, a silicon dioxide film 53 constituting an elastic film 50 is formed on the surface of the thermally oxidized wafer. In the embodiment, for the wafer 110 for a passage-forming substrate, a silicon wafer having a relatively large thickness of approximately 625 μm, and as a result, a high rigidity, is used.

Figure 3B:
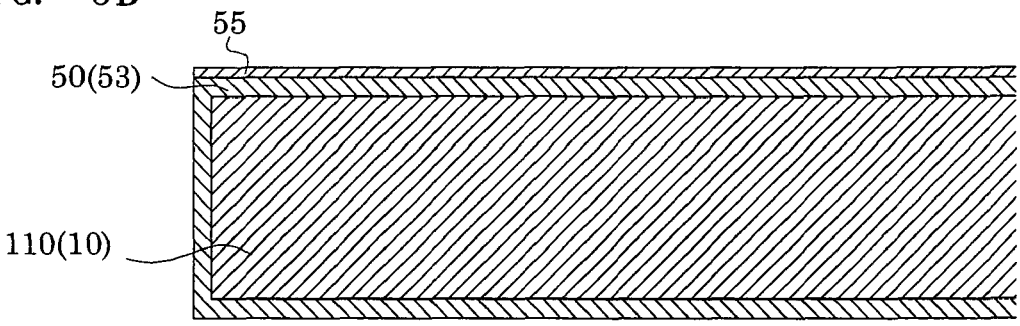

Next, as shown in FIG. 3B, the insulation film 55 made of zirconium oxide is formed on the elastic film 50 (the silicon dioxide film 53). Specifically, a zirconium (Zr) layer is firstly formed on the elastic film 50 by means of a sputtering method or the like. Then, the zirconium layer thus formed is thermally oxidized in a diffusion furnace at the temperature of, for example, 500° C. to 1200° C., so that the insulation film 55 made of zirconium oxide ($ZrO_2$) is formed.

Figure 3C:
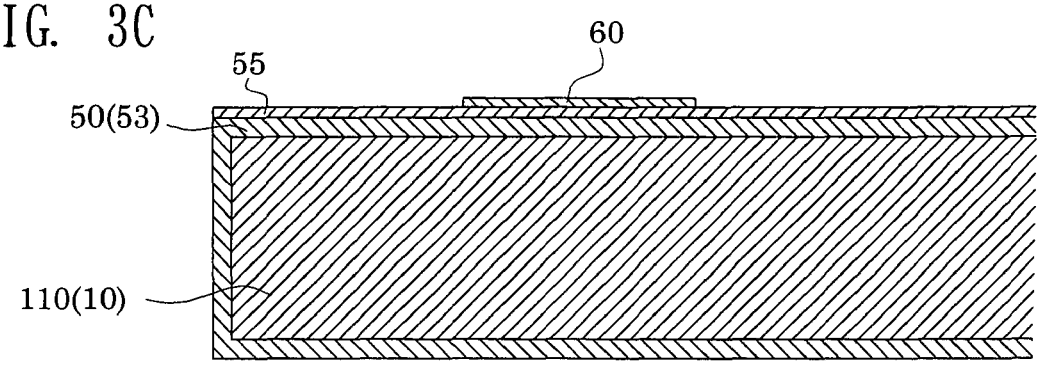
Figure 3D:
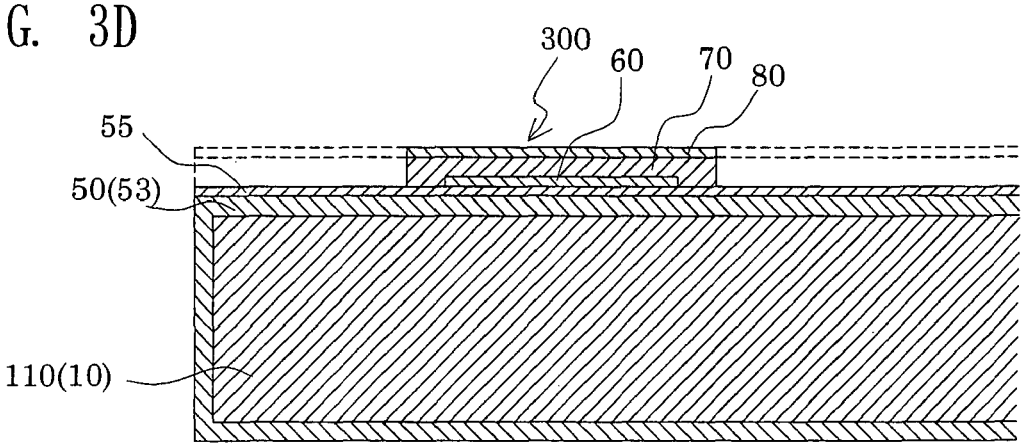

Next, as shown in FIG. 3C, a lower electrode film 60 is formed by laminating, for example, platinum (Pt) and Iridium (Ir) on the insulation film 55. Thereafter, the lower electrode film 60 thus formed is patterned into a predetermined shape. Next, as shown in FIG. 3D, the piezoelectric layer 70 made of lead-zirconate-titanate (PZT), or the like, for example, and the upper electrode film 80 made of indium, for example, are sequentially formed over the entire surface of the wafer 110 for a passage-forming substrate. Then, each of the piezoelectric elements 300 is formed by patterning the piezoelectric layer 70 and the upper electrode film 80 on a region facing each of the pressure-generating chambers 12.

It should be noted that as a material for the piezoelectric layer 70 which constitutes the piezoelectric elements 300, a ferroelectric-piezoelectric material including lead-titanate-zirconate (PZT), for example, or a relaxor ferroelectric obtained by adding metal such as niobium, nickel, magnesium, bismuth, or yttrium in the ferroelectric-piezoelectric material is used. The composition of the material can be appropriately selected by taking characteristics, applications, or the like of the piezoelectric elements 300 into consideration. The following can be given as examples: $PbTiO_3$ (PT), $PbZrO_3$ (PZ), $Pb(Zr_xTi_{1-x})O_3$ (PZT), $Pb(Mg_{1/3}Nb_{2/3})O_3$—$PbTiO_3$ (PMN—PT), $Pb(Zn_{1/3}Nb_{2/3})O_3$—$PbTiO_3$ (PZN—PT), $Pb(Ni_{1/3}Nb_{2/3})O_3$—$PbTiO_3$ (PNN—PT), $Pb(In_{1/2}Nb_{1/2})O_3$—$PbTiO_3$ (PIN—PT), $Pb(Sc_{1/2}Ta_{1/2})O_3$—$PbTiO_3$ (PST—PT), $Pb(Sc_{1/2}Nb_{1/2})O_3$—$PbTiO_3$ (PSN—PT), $BiScO_3$—$PbTiO_3$ (BS—PT), $BiYbO_3$—$PbTiO_3$ (BY—PT) or the like. Furthermore, although the method of forming the piezoelectric layer 70 is not particularly limited, in this embodiment, the piezoelectric layer 70 is formed by a so-called Sol-Gel method in which a so called sol obtained by dissolving and diffusing a metal organic substance in a catalytic agent is coated and dried so as to be turned into gel. Then, the piezoelectric layer 70 made of a metal oxide substance is obtained by baking the gel at a high temperature. As a matter of course, the piezoelectric layer 70 may be formed by use of a metal organic decomposition (MOD) method.

Figure 4A:
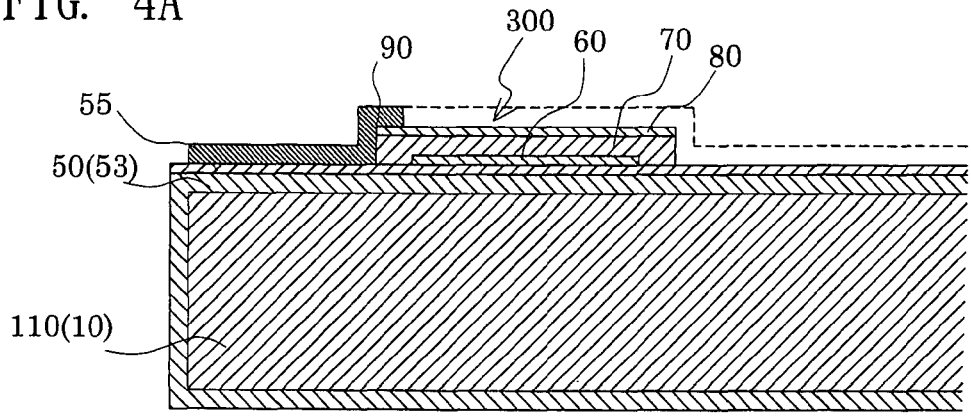
FIGS. 4A to 4C are cross-sectional views showing the manufacturing processes of the recording head according to Embodiment 1.

Next, as shown in FIG. 4A, lead electrodes 90 made of gold (Au) are formed on the entire surface of the wafer 110 for a passage-forming substrate. Thereafter, the lead electrodes 90 are patterned for the respective piezoelectric elements 300 with a mask pattern (not shown) made of a resist or the like, for example.

Figure 4B:
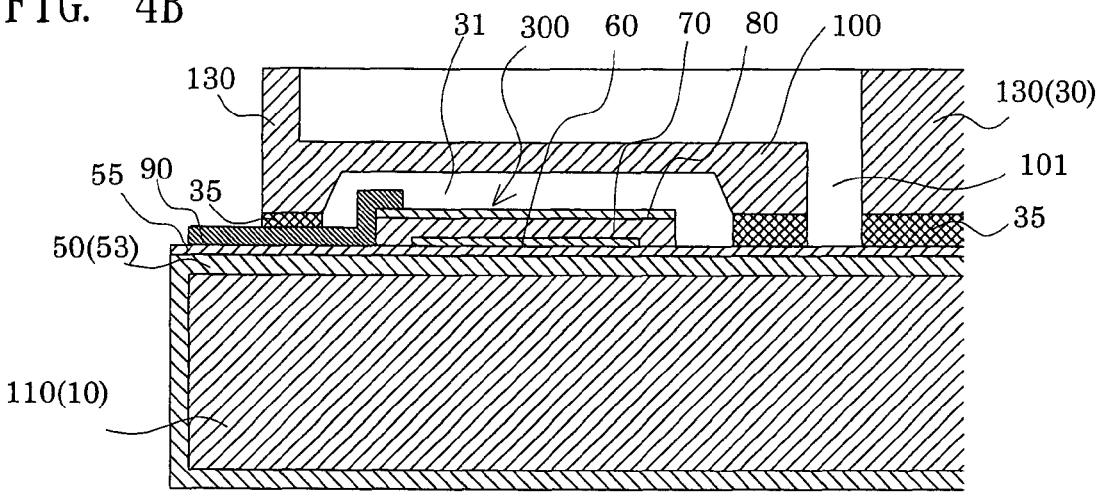

Next, as shown in FIG. 4B, a wafer 130 for a protection plate is joined to the top of the wafer 110 for a passage-forming substrate with the adhesive agent 35. Here, the piezoelectric element holding portion 31, the reservoir 100, and the through hole 101 are previously formed in this wafer 130 for a protection plate. Since this wafer 130 for a protection plate has a thickness of, for example, approximately 400 μm, the rigidity of the wafer 110 for a passage-forming substrate is significantly improved by joining the wafer 130 for a protection plate thereto.

Figure 4C:
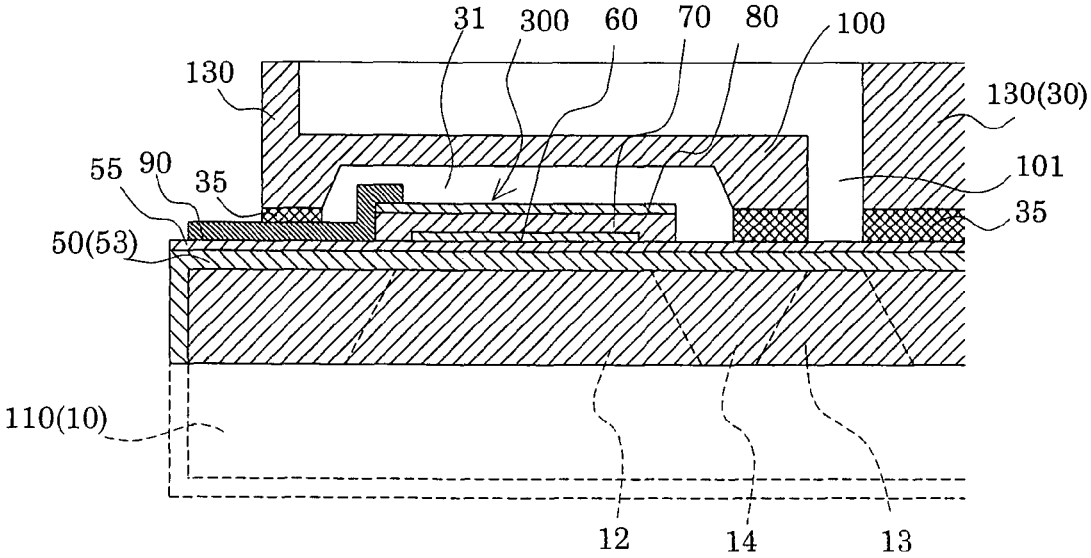
Figure 5A:
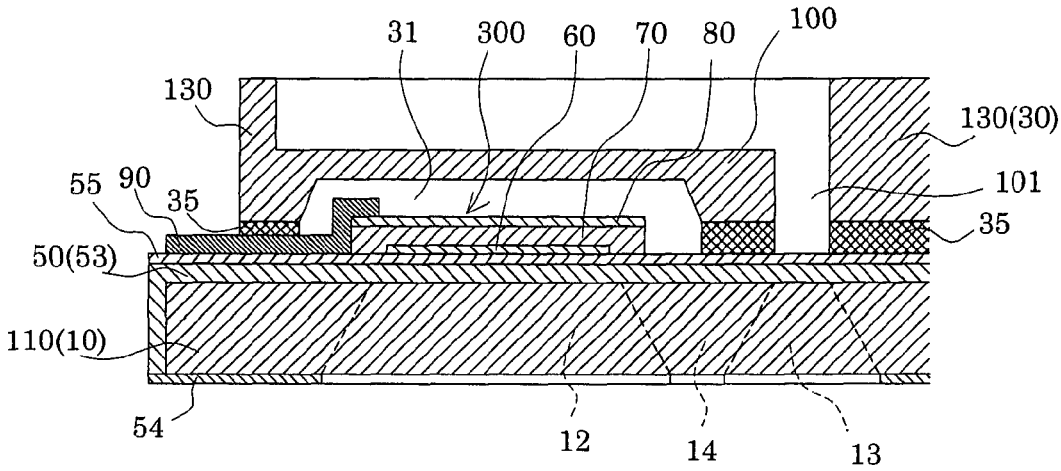
FIGS. 5A and 5B are cross-sectional views showing the manufacturing processes of the recording head according to Embodiment 1.

Next, as shown in FIG. 4C, after the wafer 110 for a passage-forming substrate is polished to have a certain thickness, the wafer 110 for a passage-forming substrate is further wet etched by use of a mixture of hydrofluoric-nitric acid as an etchant to have a predetermined thickness. For example, in this embodiment, by means of polishing, and wet etching, the wafer 110 for a passage-forming substrate is processed so as to have a thickness of approximately 70 μm. Subsequently, as shown in FIG. 5A, a mask film 54 made of silicon nitride (SiN), for example, is newly formed on the wafer 110 for passage-forming substrate, and is then patterned into a predetermined shape.

Figure 5B:
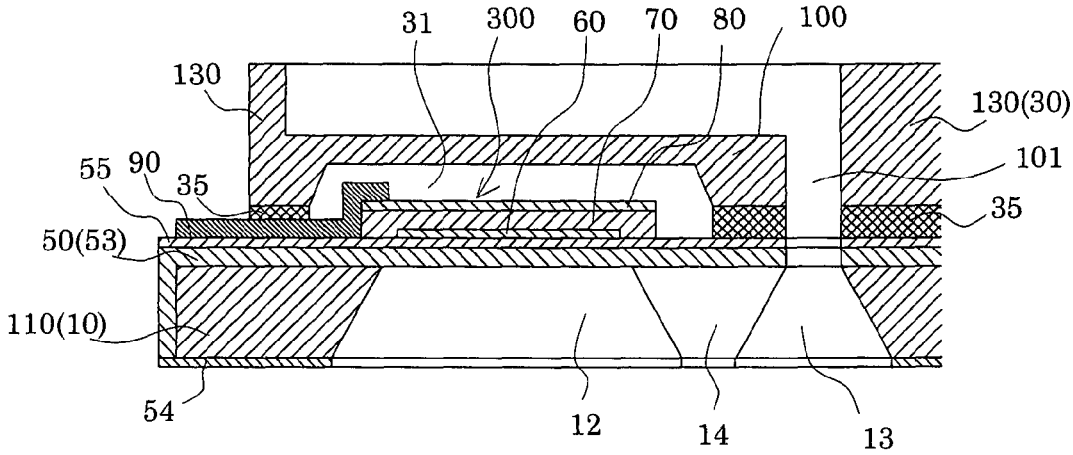

Thereafter, as shown in FIG. 5B, anisotropic etching (wet etching) using an alkaline solution, such as KOH, is performed on the wafer 110 for a passage-forming substrate with the mask film 151 thus patterned. As a result, the individual paths formed of the pressure-generating chambers 12, the communicating portions 13, and the ink supply paths 14 are formed in the wafer 110 for a passage-forming substrate.

It should be noted that when forming the individual paths in the wafer 110 for a passage-forming substrate, a surface of the wafer 130 for a protection plate, the surface being opposite to the surface of the wafer 110 for a passage-forming substrate, is preferably sealed by a sealing film made of an alkali resistant material such as polyphenylene sulfide (PPS), or poly paraphenylene terephthalamide (PPTA). Moreover, although the reservoir 100 and the through hole 101 are previously provided in the wafer 130 for a protection plate in this embodiment, it is not particularly limited to this. For example, the reservoir 100 and the through hole 101 may be formed by a wet etching method at the same time when the pressure-generating chambers 12 or the like are formed by a wet etching method after the wafer 110 for a passage-forming substrate, and the wafer 130 for a protection plate are jointed to each other. In this way, the manufacturing costs thereof can be reduced by simplifying the manufacturing processes thereof.

Thereafter, unnecessary portions of the outer peripheries of the wafer 110 for a passage-forming substrate and of the wafer 130 for a protection plate are removed by cutting the portions by use of a dicing method or the like. Then, the nozzle plate 20 having nozzle orifices 21 is joint to a surface, which is opposite to the surface of the wafer 130 for a protection plate, of the wafer 110 for a passage-forming substrate, and in the meantime, the compliance plate 40, and the head case 120 are joined to the wafer 130 for a protection plate. Then, an ink-jet recording head having the aforementioned structure is fabricated by dividing these components including the wafer 110 for a passage-forming substrate or the like into a single chip size of a passage-forming substrate 10 or the like as shown in FIG. 1.

Embodiment 2

Figure 6A:
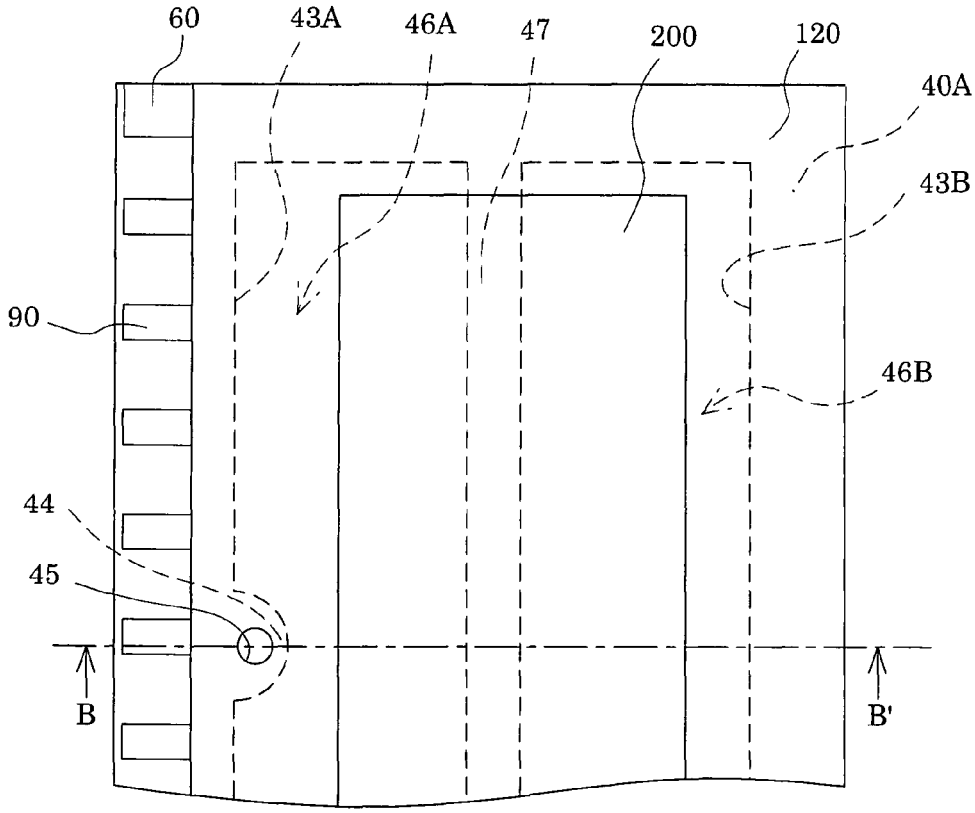
FIGS. 6A and 6B are plan and cross-sectional views of a recording head according to Embodiment 2, respectively.
Figure 6B:
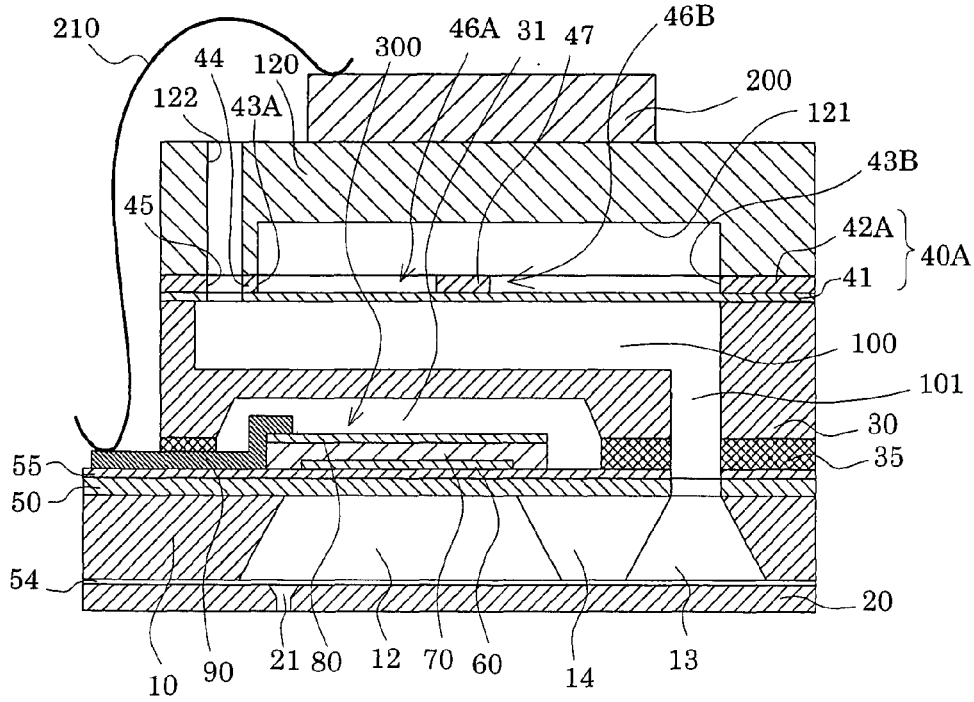

FIG. 6A is a plane view of an ink-jet recording head according to Embodiment 2, and FIG. 6B is a cross-sectional view taking along the line B-B of FIG. 6A. It should be noted that the same reference numerals are assigned to the same components as those of Embodiment 1, and the redundant descriptions of those are omitted here.

As shown in FIG. 6B, a compliance plate 40A is constituted of a sealing film 41, and a fixing plate 42A. The fixing plate 42A is provided with an opening portion 43B which opens to a part facing the through hole 101 in a region, facing the reservoir 100, of the compliance plate 40. The fixing plate 42A is also provided with an opening portion 43A which opens to a part surrounding the protrusion 44 where the introducing path is provided in the region facing the reservoir 100. The fixing plate 42A further includes a beam portion 47 which separates these opening portions 43A and 43B from each other. Specifically, a flexible portion having flexibility is formed in the region, facing the reservoir 100, of the compliance plate 40, which region covers at least from the part facing the through hole 101 to the part surrounding the introducing path 45. The beam portion 47 is formed in the middle of the flexible portion. The fixing plate 42A separately provides a flexible portion 46A including the opening portion 43A and a flexible portion 46B including the opening portion 43B, in each of which opening portion one side of the reservoir 100 is sealed with only the sealing film 41.

Even with the aforementioned configuration, it is possible to reduce the size of the ink-jet recording head while the compliance plate 40A is provided on the protection plate 30, as in the case of Embodiment 1. Accordingly, it is possible to reduce the compliance at the time of supplying to the reservoir 100, or of ejecting ink. In addition, when the size of the flexible portion is large, the flexible portion bends towards the reservoir 100 due to the weight of the flexible portion, so as to make the path narrow. However, with such a configuration including the beam portion, the negative influence of a pressure fluctuation can be reduced while the capacity of the path of the reservoir 100 is secured.

Embodiment 3

Figure 7:
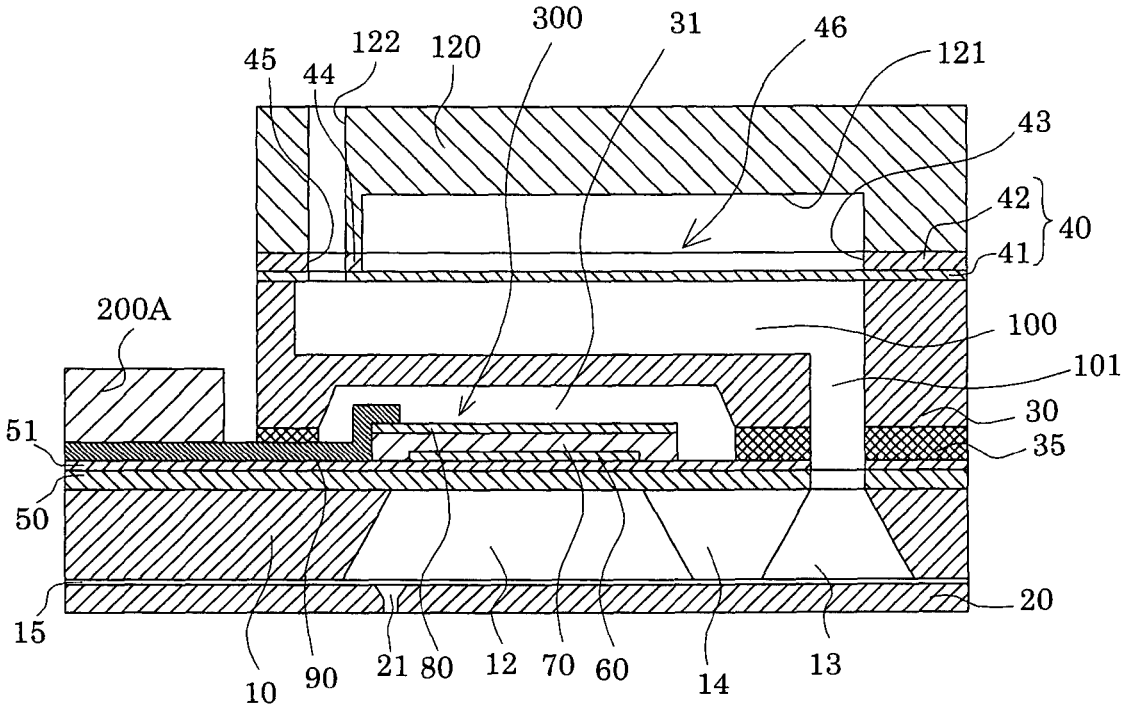
FIG. 7 is a cross-sectional view of a recording head according to Embodiment 3.

FIG. 7 is a cross-sectional view of an ink-jet recording head according to Embodiment 3 of the invention. It should be noted that the same reference numerals are assigned to the same components as those of Embodiment 1, and the redundant descriptions of those are omitted here.

As shown in FIG. 7, in Embodiment 3, the drive circuit 200A configured of a drive IC is not mounted on the head case 120, but on the top of the passage-forming substrate 10 while being arranged in parallel with the protection plate 30. In addition, the drive circuit 200A is separated from the protection plate 30.

The drive circuit 200A can be mounted directly on the lead electrodes 90 withdrawn from the piezoelectric elements 300 by use of an anisotropic conductive adhesive agent (ACF, ACP, NCF, NCP, or the like), or by means of an ultrasonic bonding method. It should be noted that the drive circuit 200A is not limited to a drive IC, but may be a tape carrier package (TCP) or the like having a drive IC implemented therein.

As described above, by mounting the drive circuit 200A on the lead electrodes 90 so as to be separated from the protection plate 30 above the passage-forming substrate 10, connecting wirings each made of a bonding wire are no longer required. As a result, the piezoelectric elements 300 can be arranged with high density. Moreover, the wirings for implementing the drive circuit 200A on the head case 120 are no longer required. As a result, the size of each piezoelectric element 300 can be reduced.

Furthermore, by causing the drive circuit 200A to be separated from the protection plate 30, an adhesive agent including an ink resistant property such as an adhesive agent to adhere the protection plate 30 to the passage-forming substrate 10 is no longer necessary when the drive circuit 200A is mounted on the top of the passage-forming substrate 10. Specifically, in order to prevent the piezoelectric elements 300 from being damaged by the ink entering into the piezoelectric element holding portion 31, the protection plate 30 needs to be adhered to the passage-forming substrate 10 by an adhesive agent including an ink resistant property. However, by causing the drive circuit 200A to be separated from the protection plate 30, the drive circuit 200A can be joined to the top of the passage-forming substrate 10 by use of an anisotropic conductive adhesive agent or by means of au ultrasonic bonding method while only the protection plate 30 is being adhered to the passage-forming substrate 10 by use of the adhesive agent having an ink resistant property. Thereby, the manufacturing processes can be simplified, and accordingly the manufacturing costs can be reduced as well.

Embodiment 4

Figure 8:
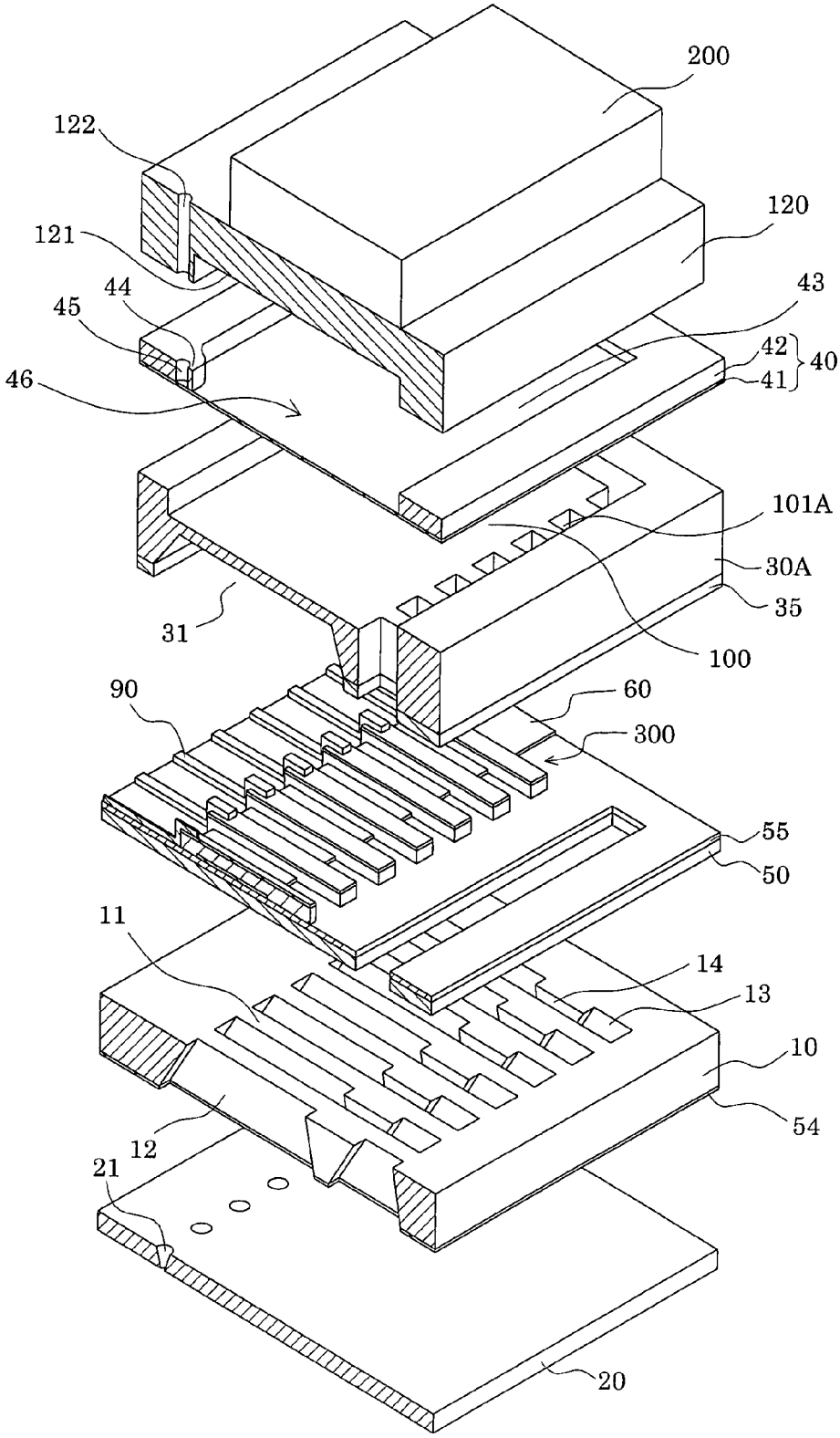
FIG. 8 is an exploded perspective view of a recording head according to Embodiment 4.
Figure 9A:
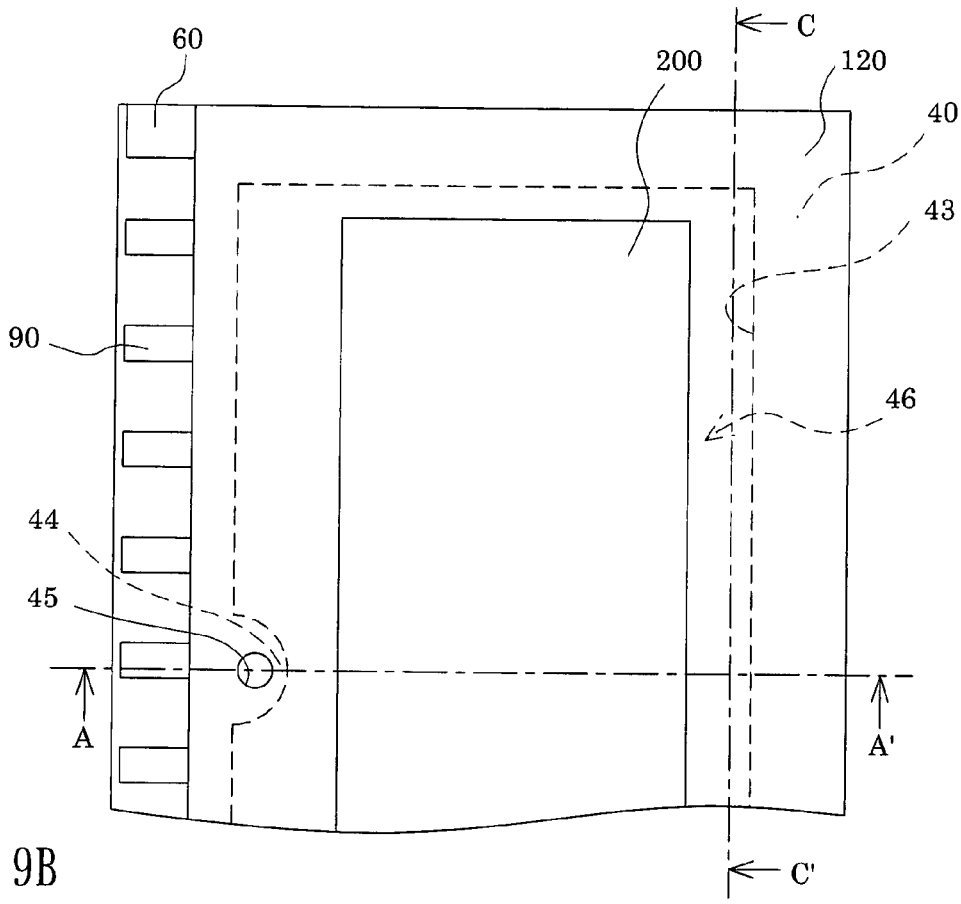
FIGS. 9A and 9B are plan and cross-sectional views of the recording head according to Embodiment 4.
Figure 9B:
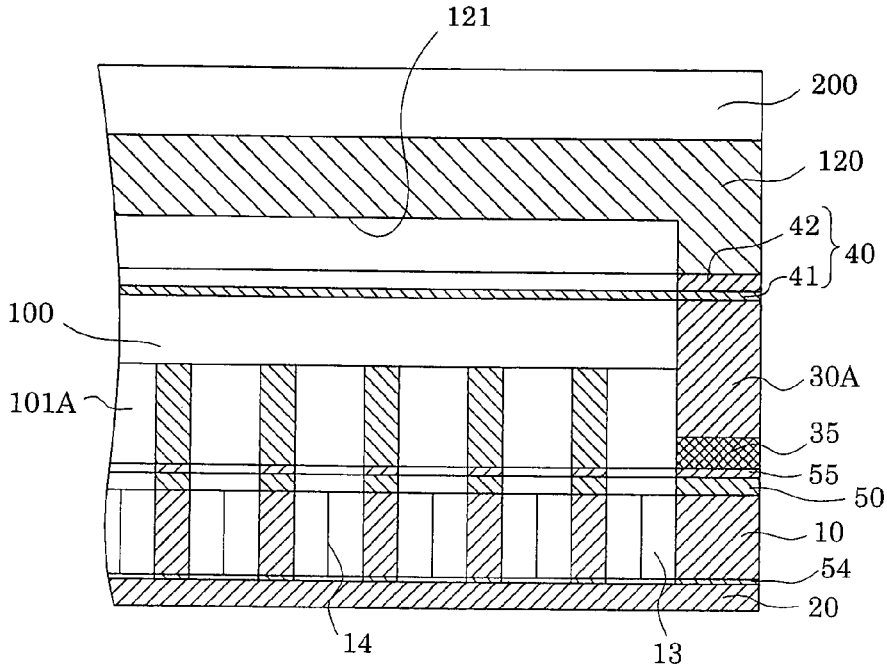

FIG. 8 is an exploded perspective view of an ink-jet recording head according to Embodiment 4 of the invention. FIGS. 9A and 9B are a plan view and a cross-sectional view of the ink jet-recording head, respectively. It should be noted that the same reference numerals are assigned to the same components as those of Embodiment 1, and the redundant descriptions of those are omitted here.

As shown in FIGS. 9A and 9B, in a protection plate 30A of the embodiment, a through hole 101A is independently provided on each individual path. Even with such a configuration, it is possible to reduce the size of the ink-jet recording head while the compliance plate 40 can be provided on a protection plate 30A as in the case of Embodiment 1. Accordingly, the compliance at the time of supplying ink to the reservoir 100, and of ejecting ink, can be reduced.

Other Embodiments

Although Embodiments 1 to 4 of the invention have been described so far, the basic configuration of the invention is not limited to those. For example, in Embodiments 1 to 4, the pressure-generating chambers 12, the ink supply paths 14, and the communicating portions 13 are provided as the individual paths. However, the configuration is not limited to this. For example, the communicating portions 13 may not be provided. In addition, in a case where the through holes 101A are provided independently for the individual paths as in the case of Embodiment 4, by causing each through hole 101A to function as an ink supply path which generates a passage resistance when ink is supplied to the pressure-generating chamber 12, the ink supply paths 14 and the communicating portions 13 may be omitted. Accordingly, only the pressure-generating chambers 12 are formed in the passage-forming substrate 10. In addition, the width of each pressure-generating chamber 12 in the longitudinal direction can be reduced, and the manufacturing costs can be reduced by simplifying the manufacturing processes.

Furthermore, in aforementioned Embodiments 1 to 4, the compliance plate 40 is configured of the sealing film 41 and the fixing plate 42 or 42A, and the flexible portions 46, 46A and 46B are formed by the opening portions 43, 43A and 43B of the fixing plates 42 and 42A, respectively. However, the invention is not limited to this. For example, the flexible portions 46, 46A, 46B or the like may be formed by partially thinning a single plate member.

Moreover, in aforementioned Embodiments 1 to 4, the compliance plate 40 or 40A formed of the sealing film 41 and the fixing plate 42 or 42A is provided on the protection plate 30 or 30A. However, the invention is not limited to this. For example, the fixing plate 42 or 42A of the compliance plate 40 or 40A may be first joined to the protection plate 30 or 30A, and thereafter the sealing film 41 may be joined to the fixing plate 42 or 42A. That is, the position of the sealing film 41 and the position of the fixing plate 42 or 42A can be reversed. Accordingly, the volume of the reservoir 100 in the thickness direction can be further increased.

In addition, in Embodiments 1 to 4, the reservoir 100 of a concave shape is provided on the opposite surface of the protection plate 30 or 30A to the passage-forming substrate 10. However, the invention is not limited to this. For example, a reservoir forming plate defining a side surface of the reservoir 100 may be provided separately on the protection plate 30. Moreover, as the reservoir forming plate, a metal material such as stainless steel (SUS), or a resin material may be used. By providing the reservoir forming plate on the protection plate 30 in the aforementioned manner, the processing of the protection plate becomes easier, and thus, the manufacturing costs thereof can be reduced.

Figure 10:
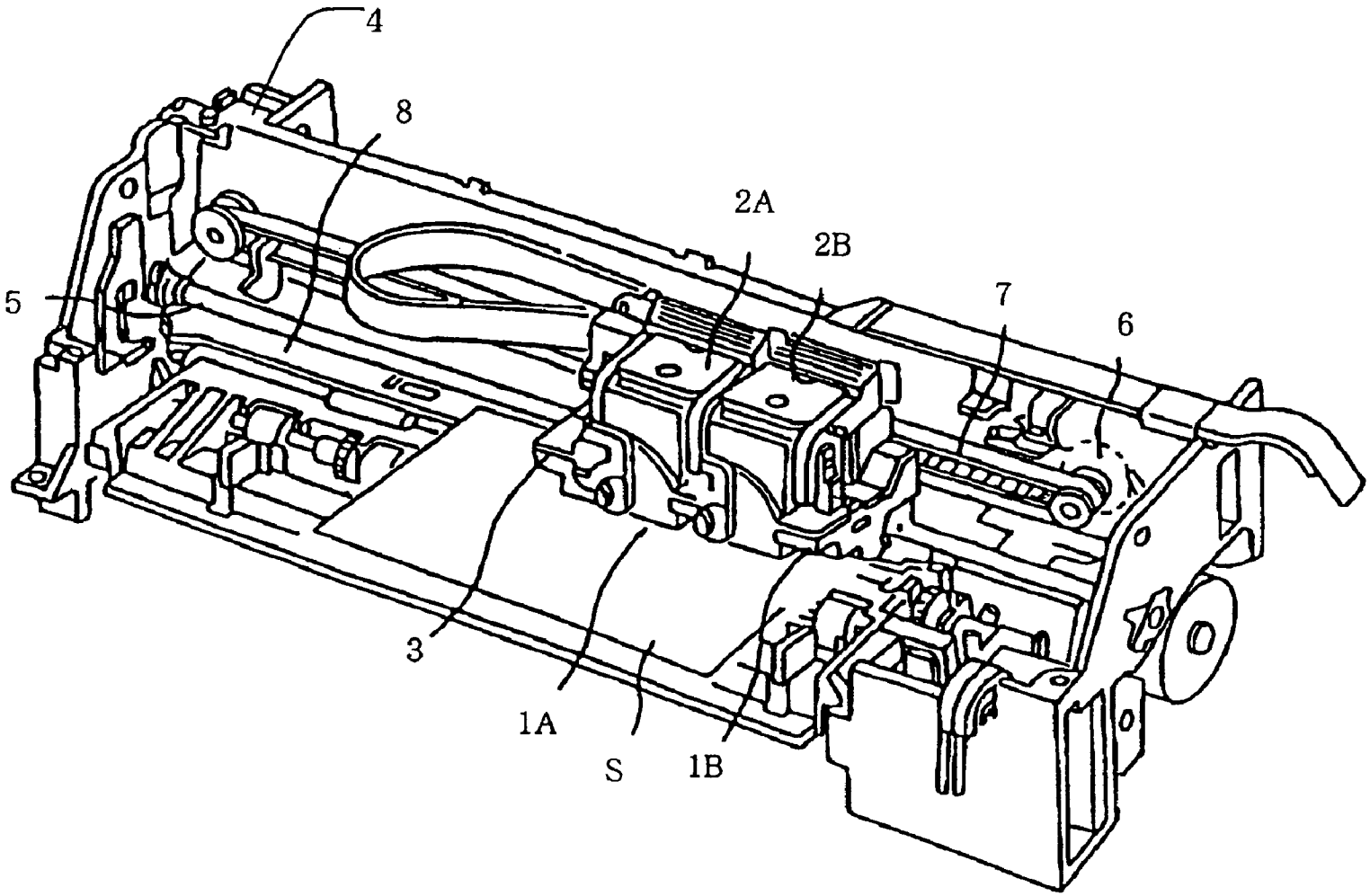
FIG. 10 is a schematic view of an ink-jet recording apparatus according to an embodiment.

Furthermore, the ink-jet recording head of each of Embodiments constitutes a part of the ink-jet recording head unit including an ink path communicating with an ink cartridge or the like, and is also installed in an ink-jet recording apparatus. FIG. 10 is a schematic diagram showing an example of the ink-jet recording apparatus.

As shown in FIG. 10, cartridges 2A and 2B each constituting an ink supplier are detachably provided respectively to recording head units 1A and 1B each including an ink-jet recording head. A carriage 3 having the recording head units 1A and 1B installed therein is mounted on a carriage shaft 5 attached to a main body 4, so as to be axially movable. The recording head units 1A and 1B are configured to eject, for example, a black ink composition and a color ink composition, respectively.

Then, the driving force of a drive motor 6 is transmitted to the carriage 3 via a plurality of unillustrated gears and a timing belt 7. With the driving force, the carriage having the recording head units 1A and 1B installed therein is moved on the carriage shaft 5. The main body 4 is provided with a platen 8 along the carriage shaft 5. A recording sheet S of a recording medium such as a sheet of paper fed by an unillustrated sheet feed roller or the like is wound around the platen 8, and then transported.

Although descriptions have been given by use of a piezoelectric element as a pressure-generating element in Embodiments, it is possible to use, as a pressure-generating element, a so-called electrostatic actuator in which a vibration plate and electrodes are disposed with predetermined spaces therebetween and the vibration of the vibration plate is controlled with an electrostatic force. In addition, although descriptions have been provided with an ink-jet recording head as an example of a liquid-jet head, the invention is intended to be widely applicable to liquid-jet heads in general. The invention can be applied to a method of manufacturing a liquid-jet head ejecting a liquid other than ink. Examples of other liquid-jet heads include various recording heads used in image recording apparatuses such as a printer, color material ejection heads used in manufacturing color filters of liquid display devices or the like, electrode-material-jet heads used in forming electrodes of organic EL display devices, field emission display (FED) devices and the like, and bio organic substance jet heads used for manufacturing bio-chips.

What is claimed is:

1. A liquid-jet head comprising:

a passage-forming substrate provided with an individual path including a pressure-generating chamber communicating with a nozzle orifice which ejects a liquid;

a pressure-generating element provided in a region facing the pressure-generating chamber on the side of a first surface of the passage-forming substrate;

a protection plate which is joined to the first surface of the passage-forming substrate on the pressure-generating chamber side, and which is provided with a pressure-generating element holding portion having the pressure-generating element arranged therein on a first surface of the protection plate;

a reservoir formed in a region on the opposite side of the first surface of the protection plate, the region overlapping the pressure-generating element holding portion in the thickness direction of the protection plate;

a compliance plate formed in a region on a surface of the reservoir on the opposite side to the passage-forming substrate the region overlapping the pressure-generating element holding portion in the thickness direction of the protection plate;

a through hole which is provided in a region in the protection plate on a first end side in the longitudinal direction of the pressure-generating chamber, and which causes the reservoir to communicate with the individual path;

an introducing path, which is provided in a region in the compliance plate on a second end side in the longitudinal direction of the pressure-generating chamber, and which supplies the liquid to the reservoir from a storage having the liquid stored therein; and a flexible portion with flexibility provided in a region of the compliance plate, the region facing the reservoir, which region covers at least from a part facing the through hole to a part surrounding the introducing path; and a head case includes a recessed portion in a region facing the reservoir, wherein the recessed portion of the head case is sealed by the compliance plate.

2. The liquid-jet head according to claim 1, wherein the flexible portion in the compliance plate is provided continuously over the pressure-generating chamber in the longitudinal direction.

3. The liquid-jet head according to claim 1, wherein a drive circuit is mounted on the top of the passage-forming substrate, the drive circuit being arranged in parallel to, and being separated from, the protection plate.

4. The liquid-jet head according to claim 1, wherein the through hole is provided independently for each individual path group formed of a plurality of individual paths.

5. The liquid-jet head according to claim 1, wherein the through hole is independently provided for each individual path.

6. The liquid-jet head according to claim 1, wherein the individual path includes at least the pressure-generating chamber and a liquid supply path which communicates with one end of the pressure-generating chamber, which has a cross-sectional area smaller than that of the pressure-generating chamber, in the width direction, and which generates a passage resistance to a liquid supplied from the reservoir.

7. The liquid-jet head according to claim 5 wherein the individual path is formed of the pressure-generating chamber, while the through hole functions as a liquid supply path which generates a passage resistance to a liquid supplied from the reservoir.

8. The liquid-jet head according to claim 1, wherein a reservoir forming plate which defines a side surface of the reservoir is joined onto the protection plate.

9. A liquid-jet apparatus comprising a liquid-jet head according to claim 1.

10. The liquid-jet head according to claim 1, wherein the compliance plate including a fixing plate, and the fixing plate includes a beam portion which is provided in a recessed portion of the head case.

11. The liquid-jet head according to claim 1, wherein the recessed portion of the head case, the reservoir, and the pressure generating element holding portion overlap each other in a thickness direction of the liquid-jet head.

* * * * *